US006293775B1

(12) United States Patent
Bakhtine

(10) Patent No.: US 6,293,775 B1
(45) Date of Patent: Sep. 25, 2001

(54) SMALL ROBUST ROTARY INTERNAL COMBUSTION ENGINE HAVING HIGH UNIT POWER AND LOW MANUFACTURING COSTS

(75) Inventor: Vladimir K. Bakhtine, Moscow (RU)

(73) Assignee: Igor V. Bakhtine, Moscow (RU)

( * ) Notice: Subject to any disclaimer, the term of this patent is extended or adjusted under 35 U.S.C. 154(b) by 0 days.

(21) Appl. No.: 09/617,057

(22) Filed: Jul. 15, 2000

(51) Int. Cl.[7] ..... F04C 18/00
(52) U.S. Cl. ..... 418/38; 418/37; 418/36
(58) Field of Search ..... 418/38, 37

(56) References Cited

U.S. PATENT DOCUMENTS

| | | | | |
|---|---|---|---|---|
| 2,050,603 | * | 8/1936 | Gardner | 418/38 |
| 2,147,290 | * | 2/1939 | Gardner | 418/38 |
| 5,433,179 | * | 7/1995 | Wittry | 418/36 |
| 5,537,973 | * | 7/1996 | Wittry | 418/36 |
| 5,622,149 | * | 4/1997 | Wittry | 418/36 |

FOREIGN PATENT DOCUMENTS

| | | | | |
|---|---|---|---|---|
| 525867-A | * | 3/1927 | (DE) | 418/38 |
| 1426042-A | * | 11/1968 | (DE) | 418/38 |
| 2351636-A | * | 4/1975 | (DE) | 418/38 |
| 4226629-A | * | 2/1994 | (DE) | 418/38 |
| 197010-A | * | 5/1923 | (GB) | 418/38 |
| 197057-A | * | 5/1923 | (GB) | 418/38 |
| 267565-A | * | 9/1927 | (GB) | 418/38 |
| 1629608-A | * | 2/1991 | (SU) | 418/38 |

* cited by examiner

*Primary Examiner*—Thomas Denion
*Assistant Examiner*—Theresa Trieu
(74) *Attorney, Agent, or Firm*—Robert Nathans

(57) ABSTRACT

In a small oscillatory type rotary piston engine, first and second rotors are provided, having first and second independently rotatable drive shafts. An engine output shaft is affixed to a rotatable carrier bowl member which carries a pair of rockers coupled to a pair of counterweighted rotor drive shaft arms each affixed to respective rotatable rotor drive shafts via first and second connecting rods. Each rocker has a centrally positioned, bearing mounted guide pin, positioned within an elliptical cam groove formed in a stationary baseplate made of hard alloy, for changing the relative angular positioning between the rotors during oscillatory, scissor action operation of the rotary piston engine. Shock-absorbent connecting rod elements are also provided within the connecting rods.

27 Claims, 4 Drawing Sheets

SMALL ROBUST ROTARY INTERNAL COMBUSTION ENGINE HAVING HIGH UNIT POWER AND LOW MANUFACTURING COSTS

BACKGROUND OF THE INVENTION

The invention relates to the field of internal combustion rotary engines, and more specifically, to such engines of the oscillatory, or scissor action, rotating type.

Throughout the history of human civilization we have striven to reduce the need to expend our muscular energy. Having first learned how to use the energy of water and wind, we went on to master the energy of steam and petrol and finally harnessed the nuclear energy. But in this uncontrolled strive for supremacy we have upset the delicate balance of nature. The depletion of non-renewable resources and total pollution of the environment are the two global problems that make it impossible for us to continue developing our industries extensively i.e. along the road that has already lead mankind into an environmental dead end.

The Public and Governments in the majority of the developed nations have already come to appreciate the serious impasse we are in. The problem however is that we have fallen hostages to the machines with which we have populated our Earth. Each automotive vehicle and nearly each mechanical gadget carries inside it a little demon that provides us with mechanical energy but claims in return non-renewable resources and pollutes our environment. The name of this demon is an internal combustion engine, or ICE.

Invented over a century ago, ICE has become an integral part of our lifestyle. In the course of its history ICE has undergone numerous modifications, all aimed at improving its two basic characteristics i.e. power rating and fuel economy. ICE's make use of different thermodynamic cycles, their components are differently arranged relative to one another, and numerous engineering solutions proliferate. They cover a broad spectrum of use from portable mechanical gadgets such as chain saws and hedge trimmers to huge locomotives and ocean going vessels. However the basic design of ICE is unchanged from what it was over a century ago and is still made up of two basic components: a piston reciprocally moving inside a cylinder and a drive mechanism based on the use of a crankshaft and connecting rods.

Medium and large sized ICE's have long been targeted by environmental criticism and their fuel economy has always been recognized as a quality important to the consumer. In past decades, this has driven the development of fuel efficient and environmentally friendly car engines based on the Diesel cycle and making use of a variety of state-of-the-art technologies. Large engineering companies throughout the world are constantly engaged in further improving their ICE's, the cost of such improvements being spread over the multi-billion revenues of the automotive, ship-building, transport and other industries. While improving the engine efficiency and reducing exhaust pollution, the incorporation of advanced electronic controls does not cause an unacceptable increase in the engine size or cost. This makes it possible for the ICE industry as a whole to follow its current path and look upon any design that does not fit the conventional reciprocal scheme as an interesting but non-essential technical curiosity.

The situation is quite different in the small ICE scene (typically up to 11 HP). The application spectrum for engines of this size is extremely broad and covers all sorts of hand-held and mobile gadgets such as chain-saws, hedge-trimmers and grass cutters, generators, compressors and pumps, motor bikes and scooters and so on. All such applications spell out similar requirements as follows:

High unit power
Small size and light weight
Simple operation and maintenance
High reliability and robustness This class of engines is also subjected to quite rigid price expectations (usually up to $100) as any unreasonable increase in price would shrink the potential market dramatically.

Up to recently this market had been dominated by the 2-stroke Otto cycle internal combustion engine with one or two cylinders, valveless, air cooled and lubricated by adding lubricant to the fuel. The indisputable advantage of this design is in its unique simplicity. The high unit power requirement is satisfied thanks to the 2-cycle operation, which means that twice the amount of fuel and air mix is pumped through the work volume. Fuel ignition in each cylinder occurs once per every revolution of the main shaft thus ensuring a more uniform rotation. This short list however exhausts the advantages of this design as all its other particulars fall under shortcomings, the principle of which are as follows:

High toxicity of exhaust gases due to:
- Charring of lubricant that is burned with the combustible mix
- Use of combustible mix for cylinder scavenging
- Degraded combustion conditions due to presence of lubricant High noise and vibration levels due to:
- High intensity of exhaust
- Poorly balanced overall design High fuel consumption due to:
- Loss of combustible mix to scavenging
- Degraded combustion conditions due to presence of lubricant Poor reliability and short service life due to:
- Highly aggressive exhaust gasses
- Intensive use of work volume
- High RPM to compensate for efficiency losses The limited advantages of the 2-stroke Otto engine had up to a point outweighed its numerous shortcomings. Yet nowadays, with the generally increased environmental awareness causing a significant tightening up of environmental regulations throughout the industrialized nations, this engine type as we know it, may be outlawed. A vast industry has suddenly found itself searching for a technical solution that would enable it to cross the new barrier.

The traditional recipes for solving the problem would be one or some of the following:

Lubrication other than through combustible mix (e.g. injection) to avoid burning lubricant
Use of supercharging to improve scavenging
Use of a valves to improve phasing
Direct fuel injection to avoid using combustible mix for scavenging
Use of electronic controls to improve combustion process
Use of catalyst to clean the exhaust All of the above solutions necessitate the installation of additional systems that would make the engine bulkier and costlier while depriving it of its cardinal advantage i.e. simplicity.

A radical solution would be to adopt the 4-stroke cycle that has been perfected by the automotive industry. But scaling down an 8-cylinder engine with 4 valves per cylinder and advanced electronic controls from 4 liters and 200 HP to a milk-pack sized engine developing under 10 HP is not a feasible engineering task. If it were, making and operating such an engine would involve unacceptable costs. Even the simple change from 2 to 4 strokes would bring about some considerable design overheads (valve system, lubrication system etc). It is also worth noting that a 4-stroke engine would exhibit lower unit power, less uniform rotation and lower maximum RPM than its 2-stroke counterpart.

The majority of known alternative power units such as external combustion engines, axial piston engines, small gas turbines, re-emerging updated 2-stroke Diesel engines and so on make a poor match to the requirements of low-end applications as summarized above. The high degree of their work volume fragmentation, the large number of auxiliary systems they require and the bulkiness of their drive mechanisms all make them an unsuitable solution for the task.

A suitable solution could be provided in the form of a rotary piston engine as such engines are distinguished by unit power that is sufficiently high to satisfy the application. Yet the majority of known arrangements of this type all have some drawbacks that prevent them from competing against the traditional reciprocal engine. Thus the well known Wankel rotary piston engine demonstrates poor fuel economy and "dirty" exhaust due to its falcate shape of the combustion chamber. Trying to scale it down is also bound to aggravate the apex seal problems typical of this engine to the extent of making it impracticable.

Another broadly promoted design is the so-called Rand-Cam engine developed by Reg Technologies of Canada on the basis of U.S. Pat. No. 4,401,070 issued to McCann in 1983. While technically much superior to the Wankel engine, the RandCam engine does not readily lend itself to downsizing due to highly fragmented work volume and the way its sliding vanes are mounted and sealed. In fact these drawbacks are typical of any rotary piston engine utilizing sliding vanes.

Yet another popular rotary piston engine dubbed ELROTO and developed in the USA is based on U.S. Pat. No. 5,484,272 issued to Horn in 1996. While based on the much more suitable oscillatory rotating arrangement (also known as scissor action or cat-and-mouse design) this particular engine makes use of a drive mechanism based on overdrive cam arrangements that have a limited life span and do not lend themselves well to downsizing. The same is true of engine designs utilizing drives based on the use of ratchets (e.g. U.S. Pat. No. 5,400,754 issued to Blanco Palacios et al in 1995), or elliptical gears (e.g. U.S. Pat. No. 4,844,708 issued to Lopez in 1998).

An oscillatory rotating engine employs a plural number of rotors with interleaved vanes around the center of rotating. By changing the angular velocity of the rotors an oscillatory movement is superimposed on their uniform rotation, thus modifying the volume of the energy chambers defined by each pair of adjacent vanes and the inner surface of the engine housing. An inlet port, exhaust port and ignition device are provided at appropriate points on the housing, so that the expansion and contraction of the working chambers will provide induction, compression, expansion and exhaust strokes. The forces that alternately drive adjacent pistons apart or together are transformed through a motion transforming mechanism into forces that drive the output shaft.

A popular arrangement of the oscillatory rotating engines makes use of a planet gear and crank drive mechanism, such type of drive employed in the engine of my U.S. patent application Ser. No. 09/523,774, filed Mar. 11, 2000. While inherently more robust, this type of drive cannot scale down sufficiently to meet the requirements of the target applications of this patent application.

At least two prior art patents disclose designs that could potentially scale down sufficiently to drive small appliances.

One is U.S. Pat. No. 4,553,503 issued to Cena in 1985, disclosing an oscillatory engine with a drive mechanism utilizing eccentric cranks linked to and driven by an eccentric ring. While the underlying approach is promising, the design particulars are such that only two strokes occur per each revolution of the output shaft, thus reducing the unit power and necessitating the complexity of a forced phasing mechanism.

The other is U.S. Pat. No. 4,053,111 issued to Cronen in 1997, disclosing a toroidal engine with a drive mechanism comprising a crank shaft, eccentric pivot arms and a four-bar linkage. While quite elegantly designed, a scaled down version of this mechanism would not ensure the needed degree of simplicity or reliability for the target applications.

It is therefore a principal object of this invention to provide a rotary piston engine that would meet the design criteria specified herein while avoiding the pitfalls listed above.

SUMMARY OF A PREFERRED EMBODIMENT OF THE INVENTION

The invention discloses a novel type of the oscillatory rotating engine utilizing a drive mechanism based on the use of pivotal arms, guide pins and profile grooves. The device can be used as an internal or external combustion engine, pump or vacuum pump. The disclosed design makes it possible to implement a small simple and reliable 4-stroke Otto-cycle internal combustion engine with a displacement up to 0.25 liter equivalent in its behavior to a 4-cylinder reciprocal engine.

The design is made up of two largely independent units, i.e. the scissor action rotary vane portion and the drive mechanism, that are joined together by a common housing. The disclosed scissor action rotary machine is similar to those known in prior art and is made up of two rotors with radial interdigitized vanes rotatable within a cylindrical housing. The vane surfaces together with the inner surface of the housing define four work chambers whose volumes vary depending on the angular positions of the rotors. Both rotors are rigidly attached to their respective drive shafts that are coaxial, with one of the shafts placed inside the other.

The rotor drive mechanism, shown in FIGS. 3 and 4, comprises a carrier bowl 2 attached to the engine output shaft 13, which is mounted in a side wall of the housing. The sides of the carrier bowl have two rockers with two associated lugs L1,L2, symmetric to its center line. Each lug pivotally mounts one end of a rocker e.g. 3*a*, the other end of which is pivotally linked to a connecting rod 5*a*, that is in turn pivotally linked to the respective arm e.g. 6*a*, rigidly attached to one of the two drive shafts, e.g. 10*a*. Each of the two rockers supports at its center point a rotatable bearing mounted pin 4*a*, the free end of which easily rolls along and within an elliptical guide groove 8, provided in a hard alloy plate attached to the internal housing wall. The groove acts as a cam and the guide pin acts as a cam follower.

The elliptical shape of the cam guide groove ensures that the two rockers in turn move to and from the engine axis, with this movement amplified and transferred to the connecting rods. The camming groove and rocker mounted pin comprise a cam device for causing the rockers to move back and forth with respect to the engine centerline, to in turn produce the relative desired angular oscillation or scissor action between the rotors.

The connecting rods 5, pivotably coupled to the rockers 3, change the angular position of the rotors relative each other by imparting the back and forth rocker movement to the drive shaft mounted arms e.g. 6 and thus to the drive shafts 10. When superimposed on the uniform rotation of the bowl, this oscillatory movement of the drive shafts ensures the necessary scissor action positioning of the rotors 12, causing all four work chambers to expand and contract in turn. The points of maximum expansion and maximum contraction for all the four volumes are fixed relative to the housing thus enabling the provision of intake and exhaust ports as well as a spark plug in the requisite positions. The overall arrangement behaves similar to a 4-stroke 4-cylinder internal combustion engine performing the Otto cycle. Due to its rotary piston nature, the disclosed design provides twice the unit power as each of the four chambers performs all four strokes per each revolution of the output shaft.

The disclosed design possesses a degree of simplicity that is comparable to a 2-stroke single cylinder engine. As the design eliminates any friction between the vanes and the housing surfaces it imposes much less stringent requirements on the strength of individual components and their machining requirements. The friction of the guide pins 4 against the elliptical camming groove 7 is minimized by supporting the pins in bearings mounted within the rockers. All the bearings provided in the design, including those supporting the output and rotor drive shafts, may be of the oilless plain type, utilizing a graphite lubricant and obviating the need for the engine to have a liquid lubrication system.

Adequate cooling of the engine may be ensured by using air to remove the excess heat and providing ribs on the outer surface of the housing. Ducts are also provided in the rotor hubs through which air is pumped to cool the rotors. The engine makes use of conventional ignition, fuel supply and starting systems.

BRIEF DESCRIPTION OF THE DRAWINGS

Other objects, features and advantages of the present invention will become more apparent upon study of the following detailed description, taken in conjunction with the drawings in which.

DETAILED DESCRIPTION OF PREFERRED EMBODIMENT OF THE INVENTION

Figure 1:
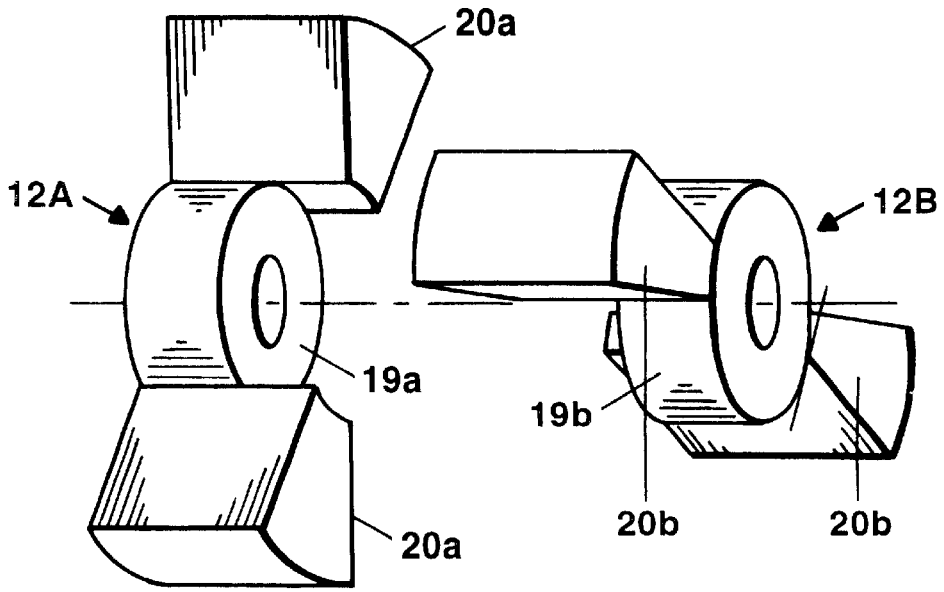
FIG. 1 is an exploded view of the rotor configuration.

As already noted above, the present invention relates to oscillatory rotating internal combustion engines. The engine shown in FIG. 4 comprises a hollow cylindrical housing 1 divided into two compartments by an internal wall 1*b*. The first compartment, shown on the left-hand side of the drawing and enclosed by the side wall 1*a*, accommodates the two rotors 12*a*/12*b*, while the second compartment shown on the right-hand side of the drawing and enclosed by side wall 1*c*, accommodates the drive mechanism. FIG. 1 shows an exploded view of the two rotors 12*a*/12*b*. Each rotor comprises a hub 19*a*/19*b* and two radial vanes 20*a*/20*b*. The hub design is such as to ensure its rigid attachment to the drive shafts 11*a*/11*b* which are responsible for positioning the rotors relative to the housing 1. Neither the drive shafts nor the housing are shown in FIG. 1.

Figure 2:
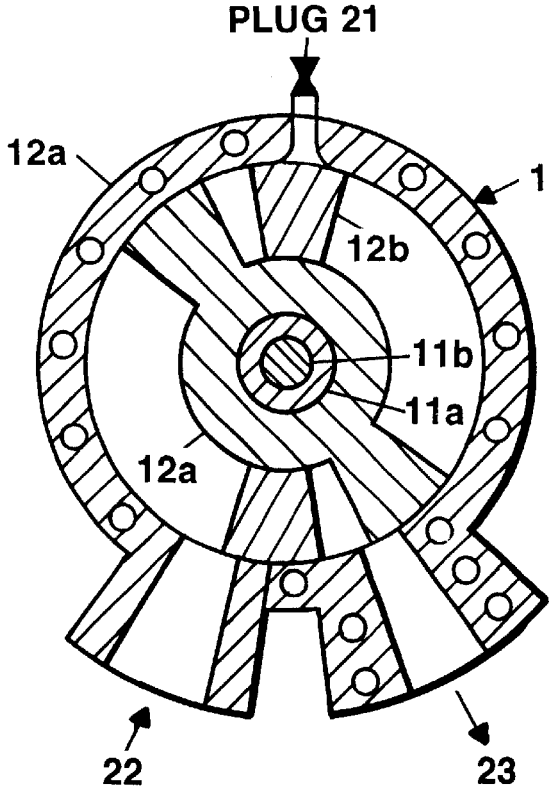
FIG. 2 is a cross section of the rotary machine.
Figure 3:
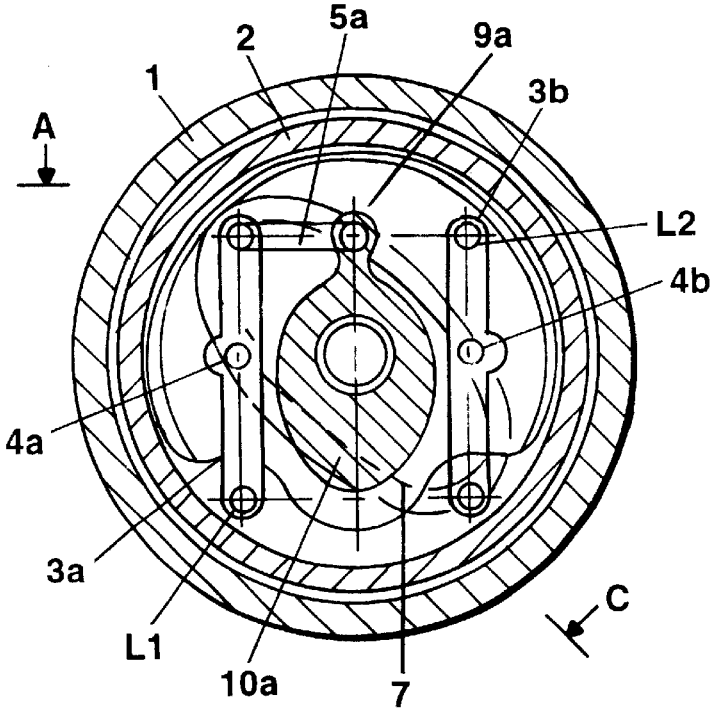
FIG. 3 is a cross section of the drive mechanism.
Figure 4:
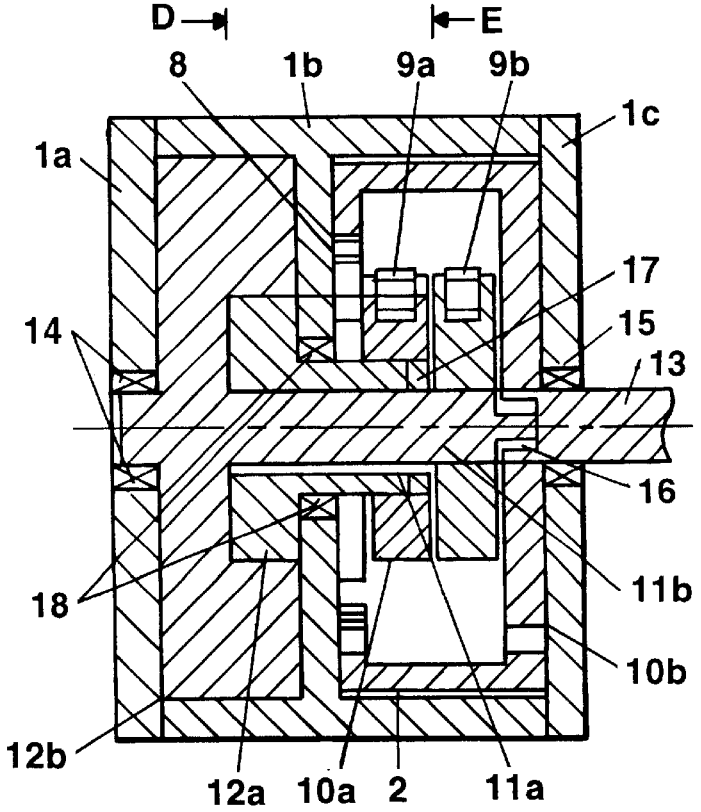
FIG. 4 is a sectional view of the preferred engine embodiment.

FIGS. 2, 3 and 4 show cross sections and longitudinal elevation of a preferred embodiment of the engine. FIG. 2 represents a cross section of the rotary machine, section D. It shows the rotors 12*a*/12*b* attached to the drive shafts 11*a*/11*b* one of which is coaxially inserted inside the other. Together with the housing 1 the rotors define four moving work chambers that in turn pass the intake area adjacent to the intake port 22, compression area up to the spark plug 21, expansion area up to where the exhaust port 23 becomes open and exhaust area up to where the exhaust port 23 becomes closed.

Figure 6:
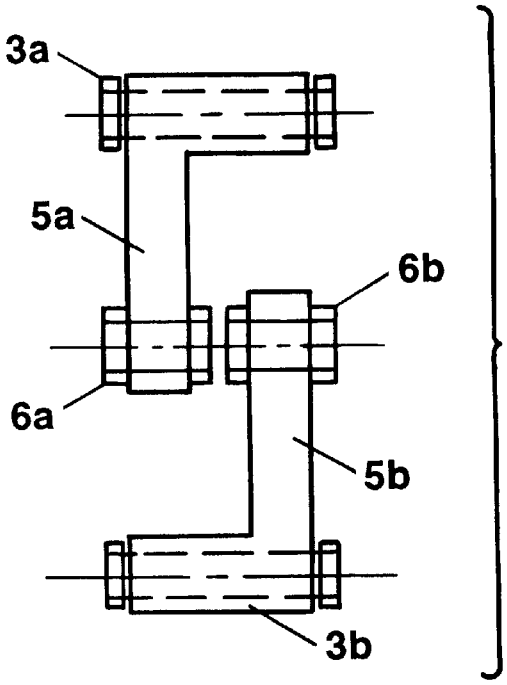
FIG. 6 illustrates the relative positions of the arms, connecting rods and their rocker mountings.

FIG. 3 illustrates the arrangement of the drive mechanism, section E. The drive mechanism is contained within the housing 1 and mounted on the carrier bowl 2. Two rockers 3*a*/3*b* are mounted on shafts supported in side lugs L1, L2 of the carrier bowl 2. A guiding pin 4*a*/4*b* is rotatably mounted in the middle of each of the two rockers by a bearing omitted for simplicity. The free end of each rocker is linked to the respective connecting rod 5*a*/5*b* which in turn is linked to one of the counterbalanced arms 6*a*/6*b* which are rigidly affixed to the respective drive shafts 11*a*/11*b*. One end of drive shaft 11*b* of rotor 12*b* is supported in bearing 14 mounted in housing wall 1*a* while its other end is supported in bearing 16 of the mount assembly which also supports output shaft 13. Drive shaft 11*a* coaxially encompasses drive shaft 11*b* with its one end supported on bearing 17 separating the two drive shafts, while its other end is supported in bearing 18 which is mounted in the inner housing wall 1*b*. The free ends of drive shafts 11*a*/11*b* on the right-hand side of the engine are rigidly attached to respective arms 6*a*/6*b* each of which incorporates a shock absorbent unit 9*a*/9*b* for linking to the connecting rods 5*a*/5*b* and a counterbalancing weight 10*a*/10*b*. The requisite oscillatory movement of the drive mechanism is imparted by guide pins 4*a*/4*b*, rolling along the elliptical groove 7, provided on the side of the hard alloy plate 8 mounted on the housing inner wall 1*b*. The connecting rods 5*a*/5*b* transmit the force via the rockers 3*a*/3*b*, not shown in the drawing, to the carrier bowl 2 which is rigidly affixed to the output shaft 13. Connecting rod 5*b*, shown in FIG. 6, is omitted from the drawing to simplify it. One side of the output shaft 13 is supported in the bearing 15 mounted in the housing wall 1*c* while its other side is supported in bearing 16 of the mount assembly that also supports the drive shaft 11*b*. For the sake of simplicity FIG. 4 does not show details of the mounting assembly supporting the rocker 3*b* in the lugs L1 and L2 of the carrier bowl 2.

Figure 5:
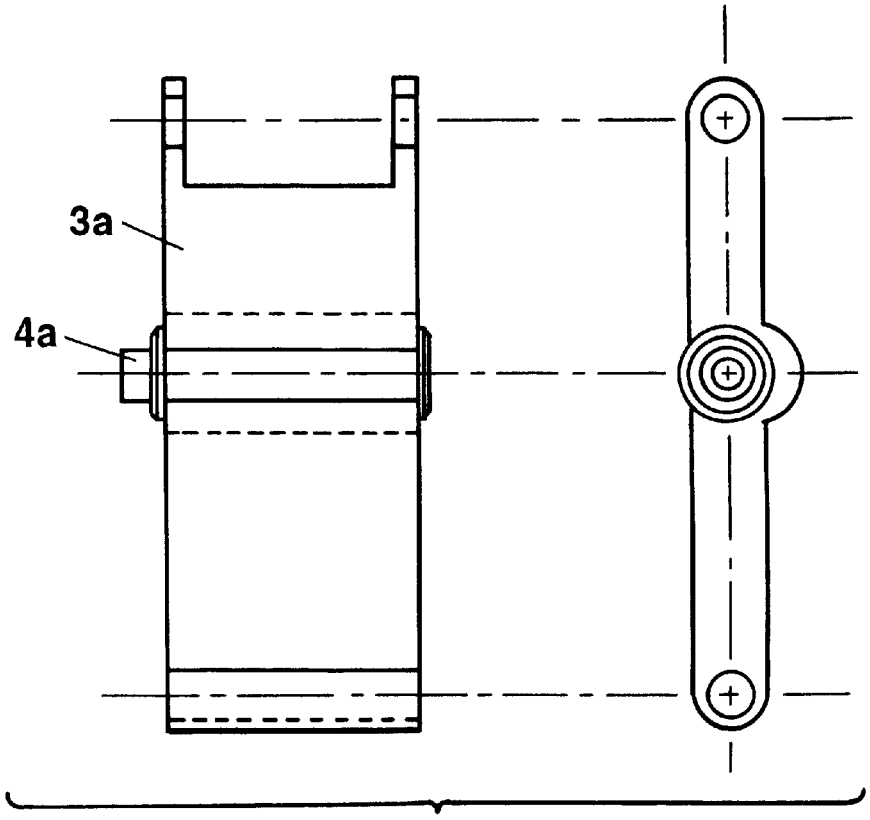
FIG. 5 provides two views of the rocker.

FIG. 5 provide two views of the rocker 3*b* that illustrate the configuration of this component as well as the method utilized for mounting the guide pin 4*a* in the middle of the rocker 3*a*.

FIG. 6, (FIG. 3, section A), illustrates the relative positions of the arms 6*a*/6*b* and connecting rods 5*a*/5*b* as well as their mounting on the free ends of the rockers 3*a*/3*b*.

While the engine is running the uniform rotation of the main or output shaft 13 is converted by the drive mechanism to unidirectional rotation of the rotors 12*a*/12*b* with their alternate speeding up and slowing down, or scissor oscillation action. One revolution of the main shaft 13 causes in each of the four chambers defined by the adjacent pair of rotor 12*a*/12*b*, vanes 20*a*/20*b* and inner surface of the housing 1, the four cycles to occur in a rigid relation to the angular position relative to the engine housing 1.

During the first cycle the chamber expands from minimum to maximum volume while passing the intake port 22, shown in FIG. 2. During the second cycle the chamber contracts to its minimum volume. Ignition occurs towards the end of the compression cycle. At this time the rotor vanes continue to close forcing the remainder of air or fuel mix into the combustion chamber.

The high pressure of the burnt gases acts on the rotor 12*a*/12*b* surfaces causing the work chamber to expand to its maximum volume. During the third cycle the work performed by the expanding gases is partly imparted via the rotor bodies to the other work chambers forcing two of them to contract and one to expand, and partly transferred via the drive shafts and drive mechanisms to the output shaft 13 in order to perform useful work. During the forth cycle the exhaust gases are forced out of the exhaust port 23 by the contraction of the work chamber to its minimum volume. Then the cycle is repeated.

The disclosed invention provides the much needed technology for building a 4-stroke Otto cycle internal combustion engine that offers the following advantages over known prior art:

1. Good downward scalability supporting displacements of up to 0.25 liter.
2. Improved robustness and reliability of the drive mechanism.
3. Improved efficiency and fuel economy.
4. Improved overall durability of the engine.
5. Simplicity of design and ease of fabrication.

Some of the above advantages accure from the improved gas dynamics as compared with the conventional 4-stroke engine due to the efficient use of work volume and use of ports instead of valves similar to a 2-stroke engine. Others are attributable to the elimination of friction between the piston and cylinder walls due to the replacement of piston rings by providing corrugations known in the art, and mentioned in my pending patent application Ser. No. 09/523,774, on the contacting surfaces and ensuring through design particulars that minimal clearances are maintained between the same in order to achieve dynamic sealing of gases. The majority of improvements however relate to the novel design of the drive mechanism.

1. The elimination of any expensive and complicated devices such as planet gears and cranks, overdrive clutches, ratchets and so on that are typical of this class of engines in the prior art.
2. Double-sided mounting of drive elements such as connecting rods, rockers and pins to compensate for the torsion loads that are typical of this kind of drive arrangements.
3. Support of the guide pins 4*a* and 4*b* in bearings, to allow their free rotation and enable them to roll along the work surface of the elliptical groove.
4. Elimination of pinions and any other design elements that are critical to impact loads of varying direction.
5. Reduction of the count of parts that have critical requirement in terms of strength and machining to just two: the guide pin and grooved plate pair.
6. The use of shock-absorbent elements in the connecting rod heads in order to reduce impact loads on the drive components.

The basic rotary machine as well as some individual components of this embodiment of the invention are similar to machines well known in prior art. A highlight of the engine of the present invention is the drive arrangement, preferably based on the guide pin-grooved plate pair and ensuring a radical simplification of design, while retaining reliability and durability inherent in the best prior art examples.

The reduction in cost and complexity thus achieved makes it possible to implement a 4-stroke 4-cylinder engine with an output of 1 HP to 20 HP that is comparable in size to a similarly rated 2-stroke engine. The radical reduction of friction between the engine work surfaces, use of oilless bearings, small part count and high degree of their repeatability all contribute to a significant reduction in the cost of fabrication and operation. On the other hand, the use of a 4-stroke cycle, reduction of pumping losses and cycle optimization, which may involve adjusting the shape of the elliptical groove slightly, relative to the shape shown in FIG. 3, until the best result is obtained, make it possible to achieve a drastic improvement in the fuel economy and environmental cleanliness characteristics of the engine of this invention. The skilled worker in the mechanics art will be able to alter the shape of the elliptical groove if a variation in the aforesaid scissor action is desired.

As mentioned above in the simplest case the groove is shaped as a true ellipse where the direction of its axes relative to the housing determines the vane closure points and their length differential determines the vane rocking angle. All the geometric parameters of the drive mechanism, such as attachment points, rocker and connecting rod lengths etc follow from the dimensions of the base ellipse, which is selected according to the strength specifications desired.

Figure 7:
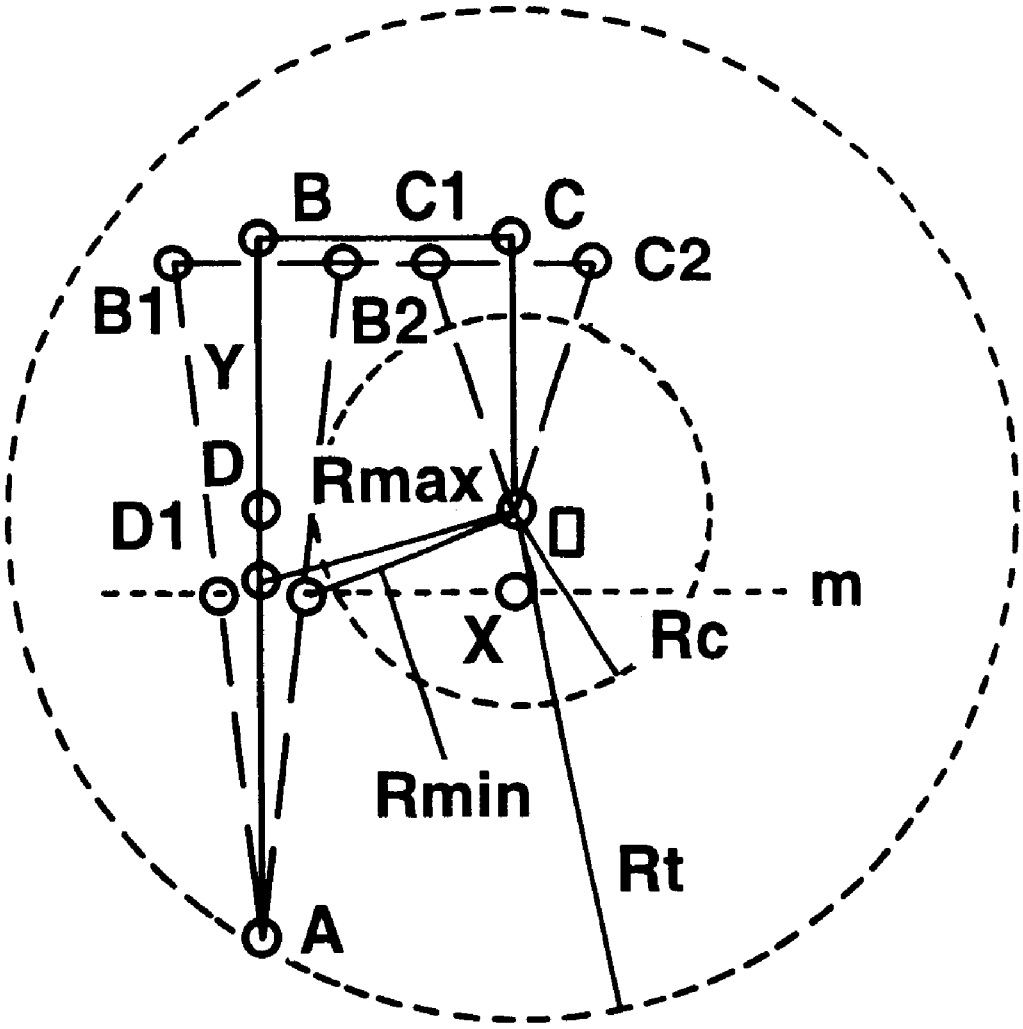
FIG. 7 illustrates a geometrical model of the drive mechanism

We shall simplify our calculations by constructing a geometrical model of the mechanism as illustrated in FIG. 7. We shall first transfer our coordinate origin zero point to the center of the carrier bowl. We shall further denote the length of the arms affixed to the rotor drive shafts as OC, the length of the connecting rods as BC and the length of the rockers as AB. Point D is thus the middle of the rocker and denotes the position of the guide pin riding in the guide groove.

Point A, the fixed end of the rocker, is located at the outer border of the carrier bowl whose radius we shall denote as Rt. The rocking movement of the rocker is limited on the one side by the outer radius Rt and is limited on the other side by the radius of inner hub Rc (taking into account the thickness of the rocker itself). Thus we have two sets of points i.e. B1, C1, D1 for one extreme position and B2, C2, D2 for the other extreme position. The distances OD1 and OD2 are thus respectively equal to the long half-axis and short half-axis of the ellipse R max R min.

Due to design considerations the rocking of all the arms must be symmetric to the middle position of the arm arrangement BCD which ensures that the transfer of force always occurs at right angles (in angles ABC and BCO). By introducing a fixed vane rocking angle $\phi=45°$ we obtain angles of 22.5° at the base of triangles COC1 and COC2. Thus the rocking stroke of connecting rod is CIC2= $2*OC*\sin(\phi/2)$.

CIC2=BIB2 as the arm is connected to the rocker by a rigid connecting rod, while D1D2A=C1C2/2 due to the similarity between D1D2A and B1B2A.

The short and long half-axis of ellipse R max R min can be calculated from two triangles, D1OX and D2OX where X is the point of intersection between straight line m and a continuation of arm OC. Straight line m is an imaginary line passing through points D1 and D2. Due to the small angle of rocker movement point D lies close to line m. This point is important in determining the value of OX in triangles DOX, D1OX, D2OX. Knowing that DX=BC, D1X=BC+OC*sin(ϕ/2)/2 and D2X=BC−OC*sin(ϕ/2)/2, we can obtain the following by applying the Pythagorean theorem to triangle AOY: $OX=SQR(Rt^2-(AB/2)^2)-AB/2$, where SQR is square root and point Y is a projection of point O onto AB.

Finally, $OD1^2=OX^2+D1X^2$, $OD2^2=OX^2+D2X^2$, or in full:

$$R\ max=SQR((SQR(Rt^2-(AB/2)^2)-AB/2)^2+(BC+OC*\sin(\phi/2)/2)^2)$$

$$R\ min=SQR((SQR(Rt^2-(AB/2)^2)-AB/2)^2+(BC-OC*\sin(\phi/2)/2)^2)$$

AB, BC and CO are thus selected on the basis of strength and other design considerations within the limits imposed by Rt, Rc.

Since variations of the foregoing description of a preferred embodiment of the invention will occur to those skilled in the art, the scope of the invention is to be restricted solely by the terms of the following claims and art recognized equivalents thereof. For example, it will be appreciated by those skilled in the art that this invention has application not only for engines, but also for pumps and compressors, even though an engine has been described in detail herein. While the oscillatory rotating engine will normally have four chambers, it is conceivable that another type of rotary engine, which can utilize the invention, may have a different number of chambers. It is also conceivable that the drive mechanisms for the two drive shafts may be split and positioned on two different sides of the housing or that the drive mechanism carrier could have a shape other than a bowl shape although the latter is greatly preferred.

I claim:

1. In an oscillatory type rotary piston engine:

(a) first and second rotors having first and second independently rotatable drive shafts affixed thereto;

(b) an engine output shaft affixed to a rotatable carrier member;

(c) first and second rocker means coupled to said rotatable carrier member at opposite portions thereof said rocker means each having a centrally positioned guide pin positioned within an elliptical groove;

(d) first and second connecting rod members pivotally coupled between said first and second rocker means and said first and second independently rotatable drive shafts respectively, for changing the relative angular positioning between said rotors during operation of said rotary piston engine.

2. The engine of claim 1 wherein each connecting rod member is pivotably coupled to an associated rotatable drive shaft via a counterbalanced arm member rigidly affixed thereto.

3. The engine of claim 1 including bearing means for enabling each guide pin to freely rotate within said elliptical groove.

4. The engine of claim 2 including bearing means for enabling each guide pin to freely rotate within said elliptical groove.

5. The engine of claim 1 wherein said first and second connecting rod members are coupled to said first and second independently rotatable drive shafts via shock-absorbent elements.

6. The engine of claim 2 wherein said first and second connecting rod members are coupled to said first and second independently rotatable drive shafts via shock-absorbent elements.

7. The engine of claim 3 wherein said first and second connecting rod members are coupled to said first and second independently rotatable drive shafts via shock-absorbent elements.

8. The engine of claim 4 wherein said first and second connecting rod members are coupled to said first and second independently rotatable drive shafts via shock-absorbent elements.

9. The engine of claim 1 wherein said elliptical groove is formed within a hardened plate affixed to a side portion of said engine.

10. The engine of claim 2 wherein said elliptical groove is formed within a hardened plate affixed to a side portion of said engine.

11. The engine of claim 3 wherein said elliptical groove is formed within a hardened plate affixed to a side portion of said engine.

12. The engine of claim 4 wherein said elliptical groove is formed within a hardened plate affixed to a side portion of said engine.

13. The engine of claim 5 wherein said elliptical groove is formed within a hardened plate affixed to a side portion of said engine.

14. In an oscillatory type rotary piston engine:

(a) first and second rotors having first and second drive means coupled thereto;

(b) an engine output shaft affixed to a rotatable carrier means;

(c) first and second rocker means each having a guide member positioned within an elliptical groove and each rocker means coupled to said rotatable carrier means; and (d) first and second connecting means coupled between said first and second rocker means and said first and second drive means respectively, for changing the relative angular positioning between said rotors during operation of said rotary piston engine.

15. The engine of claim 14 wherein said first and second connecting means each includes a counterbalanced arm member.

16. The engine of claim 14 wherein said first and second connecting means are coupled to said first and second rotors via shock-absorbent elements.

17. The engine of claim 15 wherein said first and second connecting means are coupled to said first and second rotors via shock-absorbent elements.

18. The engine of claim 14 including bearing means for enabling each guide member to freely rotate within said elliptical groove.

19. The engine of claim 15 including bearing means for enabling each guide member to freely rotate within said elliptical groove.

20. The engine of claim 16 including bearing means for enabling each guide member to freely rotate within said elliptical groove.

21. The engine of claim 17 including bearing means for enabling each guide member to freely rotate within said elliptical groove.

22. In an oscillatory type rotary piston engine:

(a) first and second independently rotatable rotors having rotor drive means coupled thereto;

(b) an engine output shaft affixed to a rotatable carrier means;

(c) first and second rocker means coupled between said rotatable carrier means and said rotor drive means via first and second connecting means; and (d) cam means coupled to said first and second rocker means for causing said first and second rocker means to move back and forth in a manner to change relative angular positioning between said rotors during operation of said rotary piston engine.

23. The engine of claim 22 wherein said connecting means includes a counterbalanced arm member.

24. The engine of claim 22 wherein said connecting means are coupled to said first and second rotor drive means via shock-absorbent elements.

25. The engine of claim 23 wherein said connecting means are coupled to said first and second rotor drive means via shock-absorbent elements.

26. In an oscillatory type rotary piston engine:

(a) first and second independently rotatable rotors having rotor drive means coupled thereto;

(b) an engine output shaft affixed to a rotatable carrier means;

(c) rocker means coupled between said rotatable carrier means and said rotor drive means; and (d) cam means coupled to said rocker means for causing said rocker means to move back and forth in a manner to change the relative angular positioning between said rotors during operation of said rotary piston engine.

27. The engine of claim 26 wherein shock-absorbing means are included within said rotor drive means.

* * * * *